US006957487B1

(12) United States Patent
Valaszkai et al.

(10) Patent No.: US 6,957,487 B1
(45) Date of Patent: Oct. 25, 2005

(54) FLUID CONVEYING TUBE AS WELL AS METHOD AND DEVICE FOR MANUFACTURING THE SAME

(75) Inventors: Laszlo Valaszkai, Sölvesborg (SE); Esad Celik, Sölvesborg (SE)

(73) Assignee: Valeo Engine Cooling, AB (SE)

( * ) Notice: Subject to any disclaimer, the term of this patent is extended or adjusted under 35 U.S.C. 154(b) by 212 days.

(21) Appl. No.: 10/033,221

(22) Filed: Dec. 27, 2001

Related U.S. Application Data

(62) Division of application No. 09/595,037, filed on Jun. 15, 2000, now Pat. No. 6,510,870.

(30) Foreign Application Priority Data

Jun. 18, 1999 (SE) ..... 9902325

(51) Int. Cl.[7] ..... B21D 21/00; B23P 15/26
(52) U.S. Cl. ..... 29/890.053; 29/890.03
(58) Field of Search ..... 29/890.053, 890.03; 165/177, 183, 179; 138/38, 115, 116, 117

(56) References Cited

U.S. PATENT DOCUMENTS

| | | | | | |
|---|---|---|---|---|---|
| 1,840,318 | A | | 1/1932 | Horvath | |
| 2,017,201 | A | | 10/1935 | Bossart | |
| 4,262,659 | A | | 4/1981 | Brzezinski | |
| 4,470,452 | A | | 9/1984 | Rhodes | |
| 5,125,453 | A | | 6/1992 | Bertrand | |
| 5,186,251 | A | * | 2/1993 | Joshi | 165/177 |
| 5,441,106 | A | | 8/1995 | Yukitake | |
| 5,579,837 | A | | 12/1996 | Yu et al. | |
| 5,689,881 | A | * | 11/1997 | Kato | 29/890.053 |
| 5,730,213 | A | | 3/1998 | Kiser | |
| 5,768,782 | A | | 6/1998 | Kato | |
| 5,890,288 | A | * | 4/1999 | Rhodes et al. | 29/890.053 |
| 5,934,128 | A | | 8/1999 | Takiura | |
| 6,067,712 | A | * | 5/2000 | Randlett et al. | 29/890.053 |
| 6,209,202 | B1 | | 4/2001 | Rhodes et al. | |
| 6,513,586 | B1 | | 2/2003 | Haussmann | |
| 6,550,533 | B2 | * | 4/2003 | Nakado et al. | 165/177 |

FOREIGN PATENT DOCUMENTS

| | | | |
|---|---|---|---|
| DE | 19548495 | A1 | 6/1997 |
| DE | 19819248 | | 4/1999 |
| EP | 0159685 | | 10/1985 |
| EP | 0590945 | | 4/1994 |
| EP | 0646231 | | 3/1997 |
| EP | 0774637 | | 5/1997 |
| EP | 0907062 | | 7/1999 |
| FR | 489 717 | | 4/1918 |
| FR | 2085 226 | | 12/1971 |
| FR | 2757258 | A1 | 6/1998 |
| GB | 521 285 | | 11/1938 |
| GB | 1 336 236 | | 4/1971 |
| GB | 2090651 | | 7/1982 |
| GB | 2159265 | | 11/1985 |
| JP | 58-140 597 | | 8/1983 |
| JP | 1 142 393 | | 5/1989 |
| JP | 01-184399 | | 7/1989 |
| JP | 10193014 | | 7/1998 |
| WO | WO 94/00726 | | 1/1994 |

OTHER PUBLICATIONS

European Search Report dated Nov. 13, 2001.

Patent Abstracts of Japan vol. 1998, No 12, Oct. 31, 1998.

International Search Report dated Dec. 21, 1999.

Carl–Olof Olsson, "Thermal and Hydraulic Performance of Enhanced Rectangular Tubes For Compact Heat Exchanger," Chalmers University of Technology, Goteborg, Sweden, Department of Thermo– and Fluid Dynamics, 1997.

* cited by examiner

*Primary Examiner*—Irene Cuda Rosenbaum
(74) *Attorney, Agent, or Firm*—Morgan & Finnegan, LLP

(57) ABSTRACT

A method of manufacturing an elongate fluid conveying tube that includes starting from a blank of metal material, wherein the fluid conveying tube is adapted to be mounted in a vehicle cooler and comprises at least two internal elongate ducts. The method of manufacturing the tube includes forming a projecting surface structure on a portion of the surface of the blank. The method also includes defining a substantially flat web portion between two upright edge portions that are formed along two opposite edges of the blank. Additionally, the method involves forming the ducts such that the edge portions are situated perpendicular to the web portion and the outer faces of said edge portions are brought into abutment against each other and against the web portion for defining said ducts.

6 Claims, 3 Drawing Sheets

FLUID CONVEYING TUBE AS WELL AS METHOD AND DEVICE FOR MANUFACTURING THE SAME

This is a divisional application of application Ser. No. 09/595,037, filed Jun. 15, 2000, now U.S. Pat. No. 6,510, 870.

TECHICAL FIELD

The present invention generally relates to vehicle coolers, and in particular to the design of fluid conveying tubes included in such coolers.

BACKGROUND ART

One type of vehicle cooler, which is, for instance, disclosed in EP-Al-0 590 945 and which is joined by brazing, comprises a heat exchanger assembly which comprises on the one hand a row of flat fluid conveying tubes, which are juxtaposed to be passed by a first fluid, for instance, liquid circulating through an engine block and, on the other, surface-enlarging means arranged between the tubes and adapted to be passed by a second fluid, e.g. cooling air. Each tube has opposite large faces, to which the surface-enlarging means are applied and which form the primary heat exchanging sides of the tube. Since for reasons of strength the large faces of the tubes cannot have an optional width, the heat exchanger assembly is generally made up of several parallel rows of tubes, which are successively arranged in the flow direction of the second fluid through the heat exchanger assembly. Therefore, between each pair of rows there is a dead zone in which there is no heat exchange between the fluids. This dead zone can consist of up to 10–15% of the total depth of the heat exchanger assembly.

In order to increase the heat exchanging capacity of the vehicle cooler, it is known to provide each tube with several internal, parallel channels or ducts, which are mutually separated by a thin partition wall. The width of the tubes can thus be increased while maintaining the strength, and the vehicle cooler can be formed without said dead zone. Such a "multichannel tube" is, for instance, known from EP-B-0 646 231.

There is, however, a constant need of improving the capacity of heat exchange in vehicle coolers, especially as there is limited space for vehicle coolers in today's vehicles at the same time as the need for cooling is increasing, in particular in trucks. An improved capacity of heat exchange can be used to increase the cooling efficiency of a cooler having a given size or to reduce the size of a cooler having a given cooling efficiency.

SUMMARY IF THE INVENTION

It is an object of the invention to provide a fluid conveying tube and a vehicle cooler which for a given size have a better capacity of heat exchange than ordinary constructions.

It is also an object to disclose a simple technique of manufacturing such a fluid conveying tube at a relatively low cost and with a low degree of rejection.

These and other objects, which will appear from the description below, have now been achieved by means of a method and a device for manufacturing according to appended claims 1 and 5, respectively, as well as a fluid conveying tube and a vehicle cooler according to appended claims 10 and 14, respectively. Preferred embodiments are defined in the dependent claims.

The surface structure which is formed on the inside of the fluid conveying tube serves to break up the laminar boundary layer which has an insulating effect and which tends to form adjacent to the primary surfaces of the tube in the fluid flowing through the tube. Thus, the surface structure contributes to further improving the capacity of heat exchange of the tube, in particular at low flow rates of fluid through the tube, without any substantial increase of the pressure drop in the fluid flowing through the tube.

By the inventive manufacturing technique, the tube can be formed in one piece starting from a blank of metal material in a simple and cost-efficient manner.

According to a particularly preferred embodiment of the inventive manufacturing technique, the blank is provided with the surface structure only after the forming of two upright edge portions along two opposite edges of the blank. This minimises the risk of irregularities occurring in the outer edges of the blank during the forming of the surface structure on the surface of the blank, because the material of the blank has a certain tendency to skew when forming the surface structure. Since the outer edges of the blank are subsequently brought into abutment against the web portion for defining the ducts, such irregularities could make it necessary to reject the tube due to leakage between the ducts.

BRIEF DESCRIPTION OF THE DRAWINGS

The invention and its advantages will now be described in more detail with reference to the accompanying schematic drawings, which by way of example show currently preferred embodiments of the present invention.

DESCRIPTION OF PREFERRED EMBODIMENTS

Figure 1:
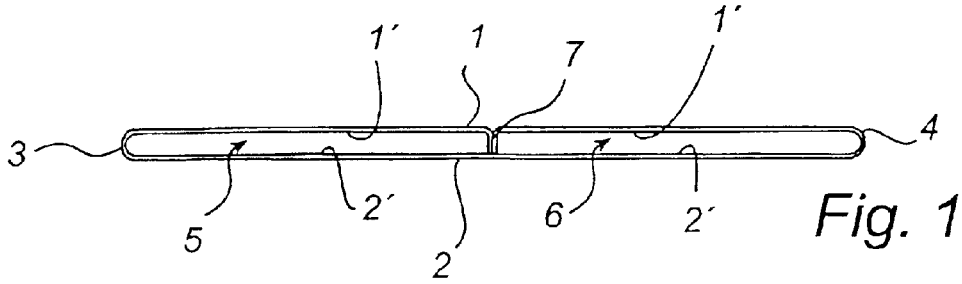
FIG. 1 is an end view of a fluid conveying tube according to the invention.

FIGS. 1–6 show preferred embodiments of a fluid conveying tube according to the invention. The tube is suitably made of a metal material, usually an aluminium material. As seen in FIG. 1, the tube is flat and has two opposite large faces 1, 2, which are substantially flat. The large faces 1, 2 are connected via two opposite, curved short sides 3, 4. When the tubes are mounted in a vehicle cooler, surface-enlarging means (not shown), for instance folded laminae, are brought into abutment against the large faces 1, 2. The principal heat exchange between the medium flowing through the tubes and the medium flowing through the surface-enlarging means about the outside of the tubes thus takes place via these large faces 1, 2. The tube internally defines two parallel ducts 5, 6, which are separated by a partition wall 7 and extend in the longitudinal direction of the tube between its ends. The large faces 1, 2 form two opposite primary heat exchange surfaces 1', 2' in each duct 5, 6.

As appears from FIGS. 2–6, the primary surfaces 1', 2' are provided with a surface structure in the form of a number of projecting, turbulence-generating elements 8, which are called dimples. These dimples 8 can have an optional design and be placed in an optional pattern on the primary surfaces 1', 2'. FIGS. 2–6 show, by way of example, different variants of the surface structure of the primary surfaces 1', 2' of the tube, the dimples 8 on the upper primary surface 1' being indicated by full lines and the dimples 6 on the lower primary surface 2' being indicated by dashed lines. In all cases, the dimples 8 on the upper and lower primary surfaces 1', 2' are relatively offset, in such manner that the tube lacks opposite dimples 8 in cross-section. This reduces the risk of clogging in the tube. Furthermore, the dimples 8 form laterally extending rows 9 on the respective primary surfaces 1', 2'. These rows 9 are alternatingly arranged on the upper and lower primary surfaces 1', 2', seen in the longitudinal direction L of the tube.

Figure 2:
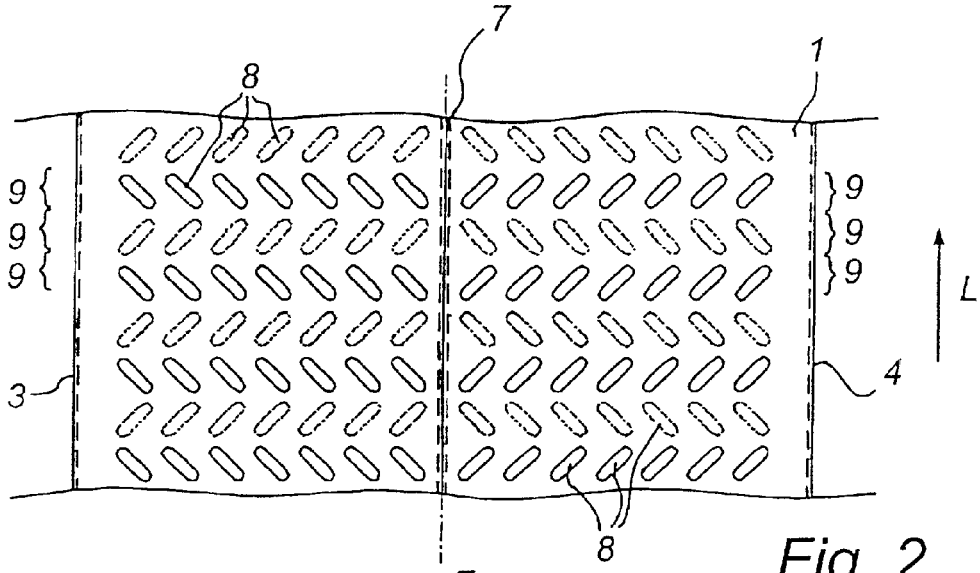
FIGS. 2–6 are top plan views of a part of fluid conveying tubes according to different variants of the present invention.
Figure 3:
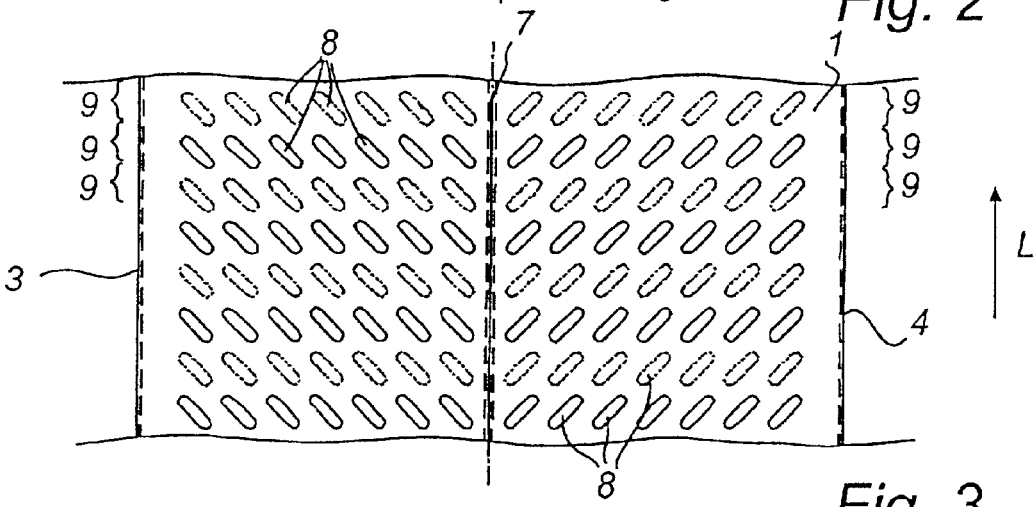

According to the variants in FIGS. 2 and 3, the dimples 8 are elongate and inclined relative to the longitudinal direction L of the tube. Within the respective rows 9, the dimples 8 are mutually parallel.

Seen in the longitudinal direction L, i.e. in the main flow direction of a fluid through the tube, successively arranged dimples 8 are alternatingly arranged on the upper and lower primary surfaces 1', 2'. According to the variant in FIG. 2, such successively arranged dimples 8 are inclined at a given mutual angle, and according to the variant in FIG. 3 they are mutually parallel.

Figure 4:
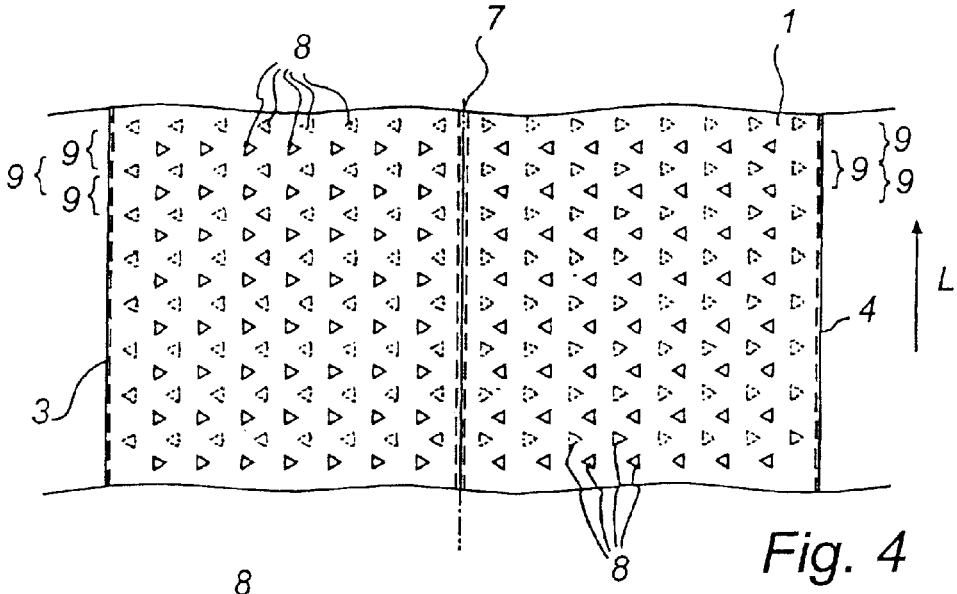
Figure 5:
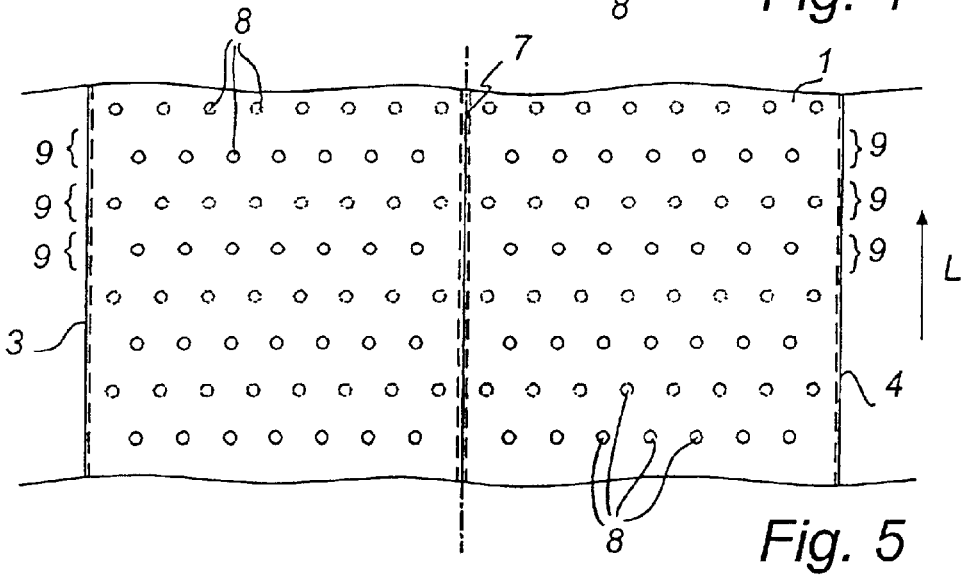
Figure 6:
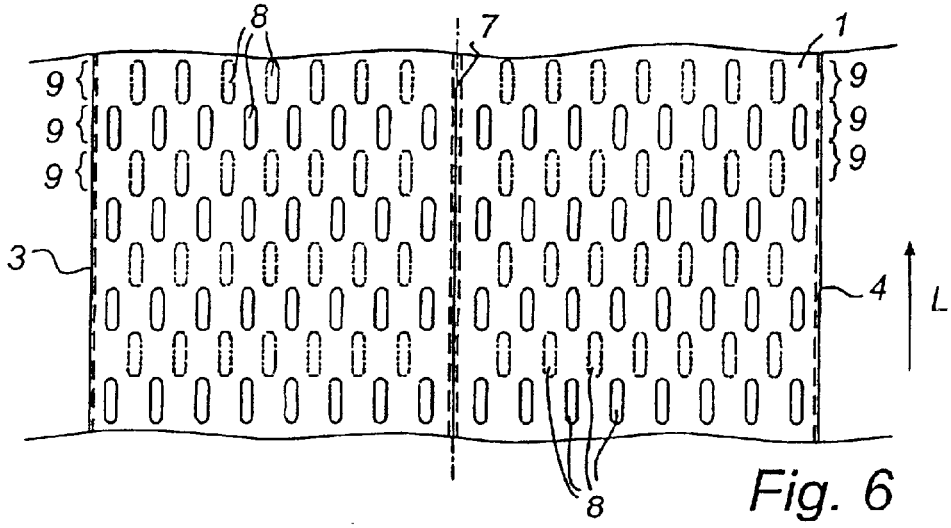

According to the variants in FIGS. 4–6, the rows 9 of dimples 8 on the upper and lower primary surfaces 1', 2' are laterally relatively offset, so that succeeding dimples 8, seen in the longitudinal direction L, are only arranged on the upper or the lower primary surface 1', 2'. In FIGS. 4 and 5, the dimples 8 are triangular and circular, respectively, in cross-section parallel with the primary surfaces 1', 2'. In FIG. 6, each dimple 8 is elongate and arranged to extend parallel with the longitudinal direction L of the tube.

Below, an inventive device for manufacturing a tube according to FIGS. 1–6 will be described in connection with FIGS. 7–8. The device is designed to reshape a substantially flat blank or band 20 of a metal material, preferably an aluminium material, into a tubular section by successive folding operations. In the device, the band 20 passes between a number of pairs of driven shafts, which are adapted to feed the band 20 through the device and are provided with profiling tools. When introduced into the device, the side faces or edges of the band 20 are substantially parallel with the feeding direction of the band, which is indicated by arrows M in FIG. 7. The device has a first station 30, in which the profiling tools fold the side faces of the band 20 substantially perpendicularly to the principal plane of the band. As appears from FIG. 8*a*, after the first station 30 the band 20 has two upright elongate edge portions 21, 22 and an intermediate flat web portion 23.

In a subsequent, second station 40, the web portion 23 of the band 20 is provided with dimples 8 in a given pattern, for instance, one of the patterns which are shown in FIGS. 2–6. The band 20 then passes between one or more combinations of a rotating abutment member 41 and a rotating shaft 42 having projections on its peripheral surface 43. While moving continuously through the second station 40, the band 20 is thus plastically deformed so that pits are formed on one of its sides and corresponding projections on its opposite side, as appears from FIG. 8*b*. It should be noted that the surface structure is very exaggerated in FIGS. 8*a*–8*e* for the sake of clarity.

Figure 8A:
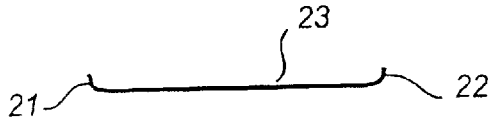
FIGS. 8*a*–8*e* are end views of a blank during the working of the same to form a fluid conveying tube, the respective end views being taken in the positions a–e in FIG. 7.
Figure 8B:
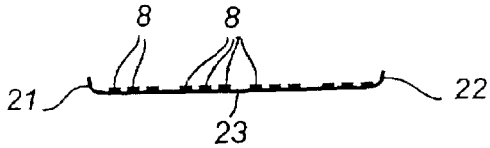
Figure 8C:
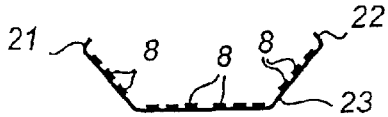
Figure 8D:
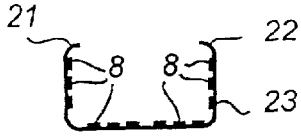
Figure 8E:
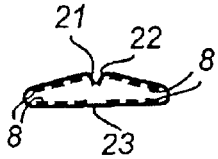

The device has a subsequent, third station 50 in which profiling tools successively fold the web portion 23 to form the two ducts 5, 6 (see FIGS. 8*c*–8*e*). In this embodiment, the upright edge portions 21, 22 are arranged against each other to form the partition wall 7 between the ducts 5, 6 (cf. FIG. 1). In addition, as shown in FIG. 1, the outer ends of the edge portions 21, 22, i.e. the longitudinal outer edges of the band 20, are applied against the web portion 23. It will be understood that a high degree of precision is required to ensure satisfactory engagement of these outer edges with the web portion 23 along the entire tube.

After the third station 50, there is preferably a cutting station (not shown), in which the formed tubular section is cut into desired lengths. However, it should be noted that, as an alternative to the above blank in the form of a continuous, elongate band, the blank can consist of substantially flat plates of a suitable dimension, which in the inventive device are formed into tubular sections of a given length. In this case, the cutting station can thus be omitted.

Figure 9:
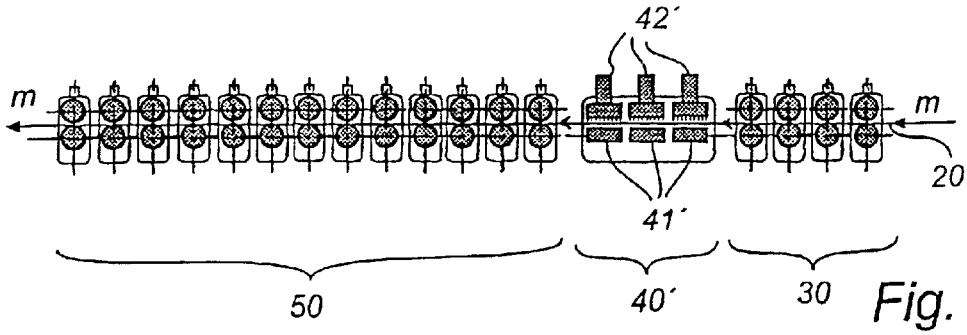
FIG. 9 is a side view of a variant of the device in FIG. 7.

According to an alternative embodiment, which is shown in FIG. 9, the second station 40' comprises one or more combinations of an abutment member 41' and a die 42'. The latter is movable perpendicularly to the band 20 to engage with the same. In contrast to the device in FIG. 7, the band 20 is indexed into the second station 40', in which the stationary band 20 is then deformed plastically, so as to form pits on one of its sides and corresponding projections on its opposite side. Otherwise, the device in FIG. 9 is identical with the device in FIG. 7 and will therefore not be described in more detail.

Figure 7:
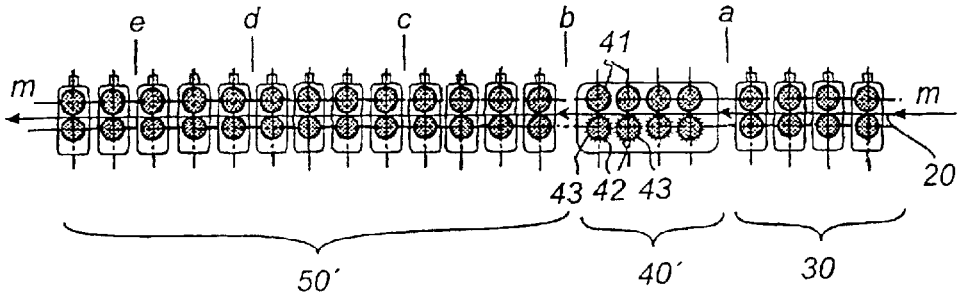
FIG. 7 is a side view of an inventive device for manufacturing a fluid conveying tube.

The tubular section discharged from the device in FIG. 7 or 9, is subsequently joined to form a tube by brazing in a furnace. It will be appreciated that the tubular section at least partially comprises filler material to form connecting brazing joints. Suitably, a filler material is applied by rolling on both sides of the blank from which the tubular section is made.

It is preferred that the tubular sections, together with the other components included in a vehicle cooler, are mounted to form an assembly, which is subsequently introduced into a brazing furnace to form a vehicle cooler in one single brazing operation. The tubes are thus formed at the same time as the rest of the vehicle cooler.

It should be noted that the inventive tube is applicable to all types of vehicle coolers having tubes arranged in parallel for cooling fluids, i.e. liquids or gases, such as liquid coolers, charge-air coolers, condensers and oil coolers.

What we claim and desire to secure by letters patent is:

1. A method of manufacturing, starting from a blank of metal material, an elongate fluid conveying tube, which is adapted to be mounted in a vehicle cooler and comprises at least two internal, elongate ducts, comprising the steps of:

forming a projecting surface structure on a portion of the surface of the blank, after forming along two opposite edges of the blank, two upright edge portions, which between themselves define an at least partly essentially flat web portion, and before forming the ducts such that the edge portions are situated substantially perpendicular to the web portion and the outer faces of said edge portions are brought into abutment against each other and against the web portion for defining said ducts.

2. A method as claimed in claim 1, wherein the surface structure, by plastic deformation of the blank, is formed as a plurality of projections in a given pattern on one side of the blank.

3. A method as claimed in claim 1, wherein the blank, in forming the surface structure, is arranged to extend through at least one embossing member, which comprises an engagement surface facing the blank and having a plurality of projections, and said projections are applied to the blank with a view to forming said surface structure.

4. A method of manufacturing, starting from a blank of metal material, an elongate fluid conveying tube, which is adapted to be mounted in a vehicle cooler and comprises at least two internal, elongate ducts, comprising the steps of:

forming a projecting surface structure on a portion of the surface of the blank, after forming along two opposite edges of the blank, two upright edge portions, which between themselves define an at least partly essentially flat web portion, and before forming the ducts such that the edge portions are brought into abutment against each other and against the web portion for defining said ducts.

5. A method as claimed in claim 4, wherein the surface structure, by plastic deformation of the blank, is formed as a plurality of projections in a given pattern on one side of the blank.

6. A method as claimed in claim 4, wherein the blank, in forming the surface structure, is arranged to extend through at least one embossing member, which comprises an engagement surface facing the blank and having a plurality of projections, and said projections are applied to the blank with a view to forming said surface structure.

* * * * *